US009845211B1

(12) United States Patent
Park et al.

(10) Patent No.: US 9,845,211 B1
(45) Date of Patent: Dec. 19, 2017

(54) MEDIA SEPARATION APPARATUS

(71) Applicant: Nautilus Hyosung Inc., Seoul (KR)

(72) Inventors: Sung Ho Park, Seoul (KR); Jin Hwan Cha, Anyang-si (KR); Jae Hoon Kwak, Seoul (KR); Kyoung Sik Kim, Seoul (KR)

(73) Assignee: NAUTILUS HYOSUNG INC., Soul (KR)

( * ) Notice: Subject to any disclaimer, the term of this patent is extended or adjusted under 35 U.S.C. 154(b) by 0 days.

(21) Appl. No.: 15/345,178

(22) Filed: Nov. 7, 2016

(51) Int. Cl.
*B65H 3/52* (2006.01)
*B65H 5/02* (2006.01)
*G07F 19/00* (2006.01)

(52) U.S. Cl.
CPC ..... *B65H 3/5269* (2013.01); *B65H 3/5215* (2013.01); *B65H 5/025* (2013.01); *G07F 19/203* (2013.01); *B65H 2404/1316* (2013.01); *B65H 2404/1415* (2013.01); *B65H 2404/262* (2013.01); *B65H 2404/264* (2013.01); *B65H 2701/1912* (2013.01)

(58) Field of Classification Search
CPC ..... B65H 3/52; B65H 3/5207; B65H 3/5215; B65H 3/5246; B65H 3/5253; B65H 3/5269; B65H 3/04; B65H 3/042; B65H 3/047; B65H 3/06; B65H 5/025; B65H 2404/1118; B65H 2404/1119; B65H 2404/1316; B65H 2404/1415; B65H 2404/262; B65H 2404/264
See application file for complete search history.

(56) References Cited

U.S. PATENT DOCUMENTS 3,944,210 A * 3/1976 McInerny ..... B65H 3/042 271/118
4,416,449 A * 11/1983 McInerny ..... B65H 3/5292 271/122
4,607,832 A * 8/1986 Abe ..... B65H 3/042 221/218
4,871,162 A * 10/1989 Imai ..... B65H 3/063 271/122

(Continued)

FOREIGN PATENT DOCUMENTS

JP 58074435 A * 5/1983 ..... B65H 3/5246
JP 58074435 A * 5/1983 ..... B65H 3/5246

(Continued)

*Primary Examiner* — Prasad V Gokhale
(74) *Attorney, Agent, or Firm* — Fenwick & West LLP

(57) ABSTRACT

A media separation apparatus may include: a pickup roller disposed at one side of the loaded media, and configured to sequentially pick up and transfer the loaded media; a feed roller disposed separately from the pickup roller in a media feeding direction, and configured to feed the media picked up and transferred by the pickup roller toward a transfer path; and a media separator disposed at a position facing the feed roller, having a plurality of separation rollers and a separation belt wound around a part of the circumference of each of the separation rollers, and configured to separate a following medium from a leading medium through friction of the separation belt, the following medium being in close contact with the leading medium fed by the feed roller and transferred at the same time as the leading medium.

6 Claims, 7 Drawing Sheets

(56) References Cited

U.S. PATENT DOCUMENTS

| | | | | | |
|---|---|---|---|---|---|
| 5,098,078 | A * | 3/1992 | Nakanishi | B65H 3/0653 | 271/10.11 |
| 5,238,236 | A * | 8/1993 | Belec | B65H 3/04 | 271/122 |
| 2004/0041330 | A1* | 3/2004 | Ko | B65H 3/0607 | 271/121 |
| 2015/0360890 | A1* | 12/2015 | Hwang | B65H 3/0638 | 271/10.01 |

FOREIGN PATENT DOCUMENTS

| | | | | | |
|---|---|---|---|---|---|
| JP | 60071428 | A * | 9/1983 | | |
| JP | 60071428 | A * | 4/1985 | B65H 3/5207 | |
| KR | 10-2015-0142518 | A | 12/2015 | | |

* cited by examiner

MEDIA SEPARATION APPARATUS

BACKGROUND

1. Technical Field

The present disclosure relates to a media separation apparatus, and more particularly, to a media separation apparatus which includes a pickup roller configured to sequentially pick up and transfer loaded media, a feed roller configured to feed the picked-up and transferred media toward a transfer path, and a media separator disposed at a position facing the feed roller, including a plurality of separation rollers and a separation belt wound around a part of the circumference of each of the separation rollers, and configured to separate a following medium from a leading medium through friction of the separation belts, the following medium being in close contact with the leading medium fed by the feed roller and transferred at the same time as the leading medium, wherein the feed roller has a guide groove formed at the center of the outer circumferential surface thereof, and a separation roller disposed at the entrance into which the picked-up and transferred media are introduced, among the plurality of separation rollers included in the media separator, has a media separation piece formed at the center of the outer circumferential surface thereof so as to protrude from the outer circumferential surface such that the end portion of the media separation piece partially overlaps the circumferential end portion of the feed roller, wherein when a bundle of two or more media overlapping each other are introduced between the feed roller and the media separator, the media separation piece blocks introduction of a following medium which is in close contact with the rear surface of a leading medium, and effectively prevents the media from being separated as a bundle of two or more media during a media separation process through the feed roller and the media separator, thereby increasing the media separation efficiency.

2. Related Art

ATM (Automated Teller Machine) refers to an automation device which assists a basic financial service such as deposit or withdrawal without a bank teller, regardless of place and time, and enables a customer to withdraw or deposit a bill or check using a medium such as card or bankbook.

When a financial transaction of a customer is a deposit transaction, the ATM receives bills or checks through a deposit/withdrawal unit, separates and transfers the bills or checks one by one, and stores the transferred bills or checks in a temporary storage unit. Then, when the financial transaction is settled, the ATM transfers and loads the bills or checks into a media cassette. Furthermore, when a financial transaction of a customer is a withdrawal transaction, the ATM separates and transfers the bills or checks loaded in the media cassette one by one, and discharges the bills or checks through the deposit/withdrawal unit.

At this time, the deposit/withdrawal unit, the temporary storage unit and the media cassette in which media (bills or checks) are loaded, in the ATM, include a media separation apparatus which separates the loaded media (bills or checks) one by one and transfers the separated media.

The media separation apparatus includes a pickup roller, a feed roller and a separation roller. The pickup roller is pressed against the stored media and picks up a medium. The feed roller feeds the medium picked up by the pickup roller along a media feeding direction. The separation roller faces the feed roller with a medium interposed therebetween, and separates another medium which is in close contact with the rear surface of the medium fed by the feed roller and transferred at the same time as the medium.

Recently, various types of enhanced media separation apparatuses have been developed in order to increase media separation efficiency. The present applicant has filed an application for a media separation apparatus having a media separation structure using a belt, as an example of the media separation apparatuses.

FIGS. 1A and 1B are diagrams illustrating a conventional media separation apparatus for ATM.

As illustrated in FIG. 1A, the conventional media separation apparatus includes a pickup roller 20, a feed roller 30 and a media separator 40. The pickup roller 20 is pressed against loaded media 10 and picks up a medium 10. The feed roller 30 feeds the medium 10 picked up by the pickup roller 20 along a media feeding direction. The media separator 40 is disposed under the feed roller 30, and includes a pair of separation rollers 41 and 42 and a separation belt 43 wound around the pair of separation rollers 41 and 42. The media separator 40 separates a following medium 11 from a leading medium 11 transferred by the pickup roller 20 and the feed roller 30 through friction of the separation belt 43, the following medium 11 being in close contact with the leading medium 11 and transferred at the same time as the leading medium 11.

In such a structure, the pickup roller 20 sequentially picks up the loaded media 10, the feed roller 30 feeds the medium 11 picked up by the pickup roller 20, and the media separator 40 separates the following medium 12 through the friction of the separation belt 43 which is stopped or rotated in the opposite direction of the pickup roller 20, the following medium 12 being in close contact with the bottom surface of the leading medium 11 fed by the feed roller 30 and transferred at the same time as the leading medium 11. In this way, the conventional media separation apparatus separates and transfers the media one by one.

However, the conventional media separation apparatus has the following problem. When a bundle of three or more media 11 to 13 overlapping each other is simultaneously introduced between the feed roller 30 and the separation belt 43 as illustrated in FIG. 1B, the separation belt 43 separates only the medium 13 which is positioned at the lowermost and contacted with the separation belt 43, among the bundle of overlapping media 11 to 13. As a result, two or more media 11 and 12 may be transferred through the transfer path, thereby causing a transfer error such as jam in the transfer path.

SUMMARY

Various embodiments are directed to a media separation apparatus which includes a pickup roller configured to sequentially pick up and transfer loaded media, a feed roller configured to feed the picked-up and transferred media toward a transfer path, and a media separator disposed at a position facing the feed roller, including a plurality of separation rollers and a separation belt wound around a part of the circumference of each of the separation rollers, and configured to separate a following medium from a leading medium through friction of the separation belts, the following medium being in close contact with the leading medium fed by the feed roller and transferred at the same time as the leading medium, wherein the feed roller has a guide groove formed at the center of the outer circumferential surface thereof, and a separation roller disposed at the entrance into which the picked-up and transferred media are introduced, among the plurality of separation rollers included in the media separator, has a media separation piece formed at the center of the outer circumferential surface thereof so as to protrude from the outer circumferential surface such that the end portion of the media separation piece partially overlaps the circumferential end portion of the feed roller, wherein when a bundle of two or more media overlapping each other are introduced between the feed roller and the media separator, the media separation piece blocks introduction of a following medium which is in close contact with the rear surface of a leading medium, and effectively prevents the media from being separated as a bundle of two or more media during a media separation process through the feed roller and the media separator, thereby increasing the media separation efficiency.

In an embodiment, there is provided a media separation apparatus which separates loaded media one by one and transfers the separated media toward a transfer path. The media separation apparatus may include: a pickup roller disposed at one side of the loaded media, and configured to sequentially pick up and transfer the loaded media; a feed roller disposed separately from the pickup roller in a media feeding direction, and configured to feed the media picked up and transferred by the pickup roller toward the transfer path; and a media separator disposed at a position facing the feed roller, having a plurality of separation rollers and a separation belt wound around a part of the circumference of each of the separation rollers, and configured to separate a following medium from a leading medium through friction of the separation belt, the following medium being in close contact with the leading medium fed by the feed roller and transferred at the same time as the leading medium. The feed roller may have a guide groove formed at the center of the outer circumferential surface thereof, and a separation roller disposed at an entrance into which the picked-up and transferred medium is introduced, among the plurality of separation rollers, may have a media separation piece which protrudes from the center of the outer circumferential surface of the separation roller such that the protruding end portion thereof is inserted into the guide groove of the feed roller. While the medium picked up and transferred by the pickup roller is introduced between the feed roller and the media separator, the media separation piece may block the introduction of the following medium contacted with the rear surface of the leading medium.

DETAILED DESCRIPTION

Hereafter, exemplary embodiments will be described below in more detail with reference to the accompanying drawings. The disclosure may, however, should not be constructed as limited to the embodiments set forth herein.

A media separation apparatus included in an ATM is installed in a deposit/withdrawal unit that receives media (bills or checks) inserted by a customer, a temporary storage unit that temporarily stores the deposited media until a transaction is settled, or a media cassette that stores media for transaction, and configured to separate the stored media one by one.

Figure 1A:
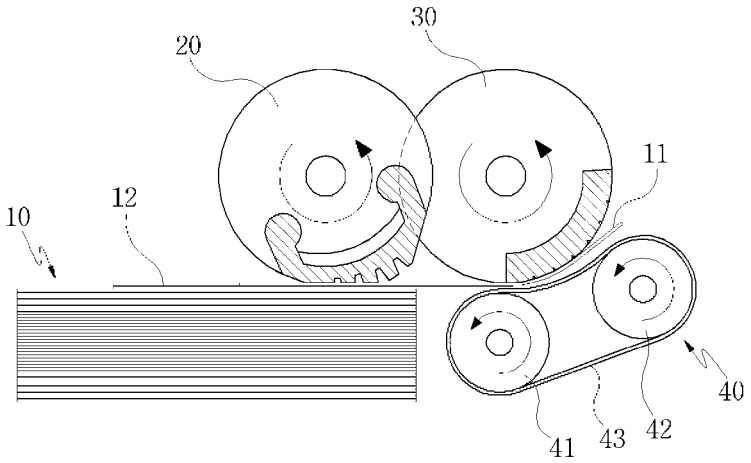
FIGS. 1A and 1B are diagrams illustrating a conventional media separation apparatus.
Figure 1B:
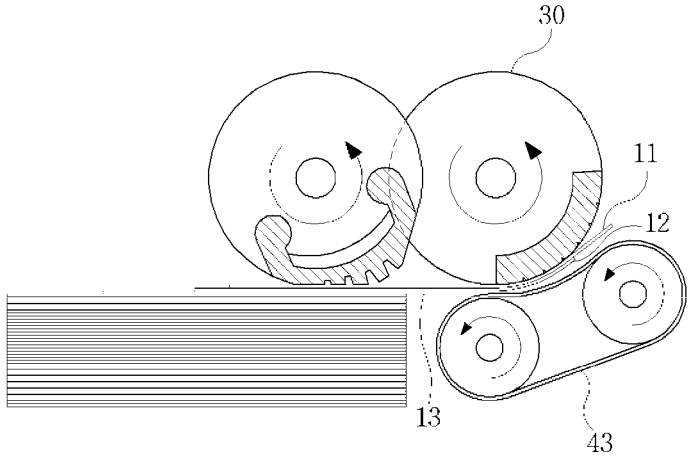
Figure 2:
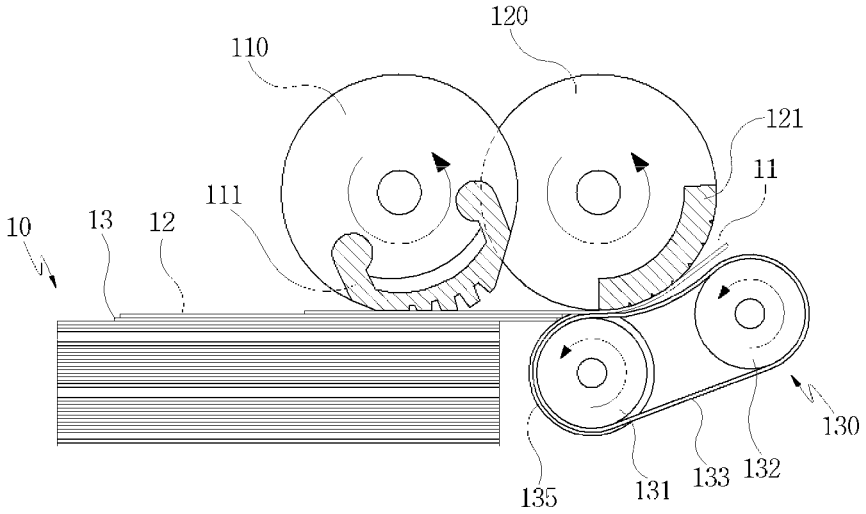
FIG. 2 is a side view illustrating a schematic configuration of a media separation apparatus according to an embodiment of the present invention.
Figure 3:
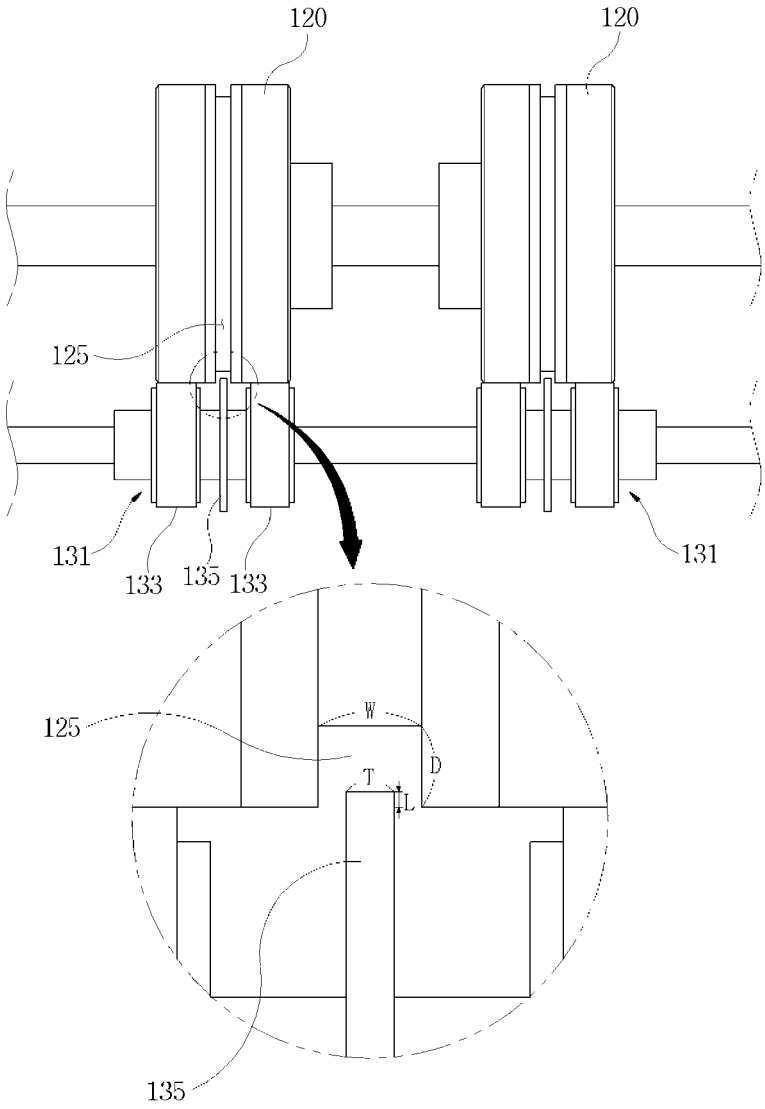
FIG. 3 is a diagram an overlap structure between a feed roller and a first separation roller of a media separator, which are arranged to face each other, according to the embodiment of the present invention.

FIG. 2 is a side view illustrating the schematic configuration of a media separation apparatus according to an embodiment of the present invention, and FIG. 3 is a diagram illustrating an overlap structure between a feed roller and a first separation roller of a media separator, which are arranged to face each other, according to the embodiment of the present invention.

As illustrated in FIGS. 2 and 3, the media separation apparatus according to the embodiment of the present invention includes a pickup roller 110, a feed roller 120 and a media separator 130. The pickup roller 110 is disposed at one side of loaded media 10, and sequentially picks up and transfers the loaded media 10. The feed roller 120 is disposed separately from the pickup roller 110 in a media feeding direction, and feeds a medium 10 picked up by the pickup roller 110 toward a transfer path. The media separator 130 is disposed at a position facing the feed roller 120, includes a plurality of separation rollers 131 and 132 and a separation belt 133 wound around a part of each of the separation rollers 131 and 132, and separates a following medium 12 from a leading medium 11 fed by the feed roller 120 through friction of the separation belt 133, the following medium 12 being in close contact with the leading media 11 and transferred at the same time as the leading medium 11. The feed roller 120 has a guide groove 124 formed at the center of the outer circumferential surface thereof, and the separation roller 131 disposed at a media entrance between the plurality of separation rollers 131 and 132 of the media separator 130 has a media separation piece 135 protruding from the center of the outer circumferential surface thereof. The protruding end of the media separation piece 135 is inserted into the guide groove 124 of the feed roller 120.

That is, the media separation apparatus according to the embodiment of the present includes the pickup roller that sequentially picks up and transfers loaded media, the feed roller that feeds the picked-up and transferred media toward the transfer path, and the media separator that is disposed at a position facing the feed roller, includes the plurality of separation rollers and the separation belt wound around a part of each of the separation rollers, and separates a following medium from a leading medium feed by the feed roller through the friction of the separation belt, the following medium being in contact with the leading medium and transferred at the same time as the leading medium. The feed roller has the guide groove formed at the center of the outer circumferential surface thereof, and the separation roller disposed at the media entrance into which the medium fed by the feed roller is introduced, among the plurality of separation rollers included in the media separator, has the media separation piece formed at the center of the outer circumferential surface thereof so as to protrude to the outside of the outer circumferential surface. The circumferential end of the feed roller partially overlaps the end of the media separation piece. Thus, when a bundle of two or more media overlapping each other is introduced between the feed roller and the media separator, the media separation apparatus blocks the introduction of the following medium through the media separation piece, the following medium being in close contact with the rear surface of the leading medium and transferred at the same time as the leading medium. Therefore, the media separation apparatus can effectively prevent media from being separated as a bundle of two or more media during the media separation process by the feed roller and the media separator, thereby increasing the media separation efficiency.

Hereafter, referring to FIGS. 2 and 3, the configuration of the media separation apparatus according to the embodiment of the present invention will be described in more detail.

The pickup roller 110 is disposed at one side of the loaded media 10, sequentially picks up the loaded media 10 from the top, and transfers the picked-up media toward the feed roller 120.

The pickup roller 110 has a pickup member 111 protruding from a part of the outer circumferential surface of the roller body so as to come in contact with the media 10. When the pickup roller 110 is rotated in the media feeding direction, the pickup member 111 formed on a part of the outer circumferential surface of the roller body in the pickup roller 110 sequentially picks up the loaded media 10 from the top and transfers the picked-up media 10 toward the feed roller 120, while rotating along the circumference of the roller body.

That is, the pickup member 111 protruding from the pickup roller 110 is formed on a part of the outer circumferential surface of the roller body, in order to pick up one of the loaded media 10 and transfer the picked-up medium 10 toward the feed roller 120 whenever the pickup roller 110 takes a round. Since the circumference of the pickup roller 110 corresponds to the length of the loaded media 10, the pickup member 111 of the pickup roller 110 can pick up one of the loaded media 10 at each round and transfers the picked-up media 10.

The feed roller 120 is disposed separately from the pickup roller 110 in the media feeding direction, and feeds the medium 10 picked up and transferred by the pickup roller 110 toward the transfer path.

At this time, the feed roller 120 has the same diameter as the pickup roller 110, includes a friction member 121 formed on a part of the outer circumferential surface of the roller body so as to come in contact with the medium 10, and rotates in phase with the pickup roller 110.

Thus, when the feed roller 120 is rotated, the friction member 121 formed on a part of the outer circumferential surface of the roller body in the feed roller 120 feeds the medium 10 picked up and transferred by the pickup roller 110 toward the transfer path, while being rotated along the circumference of the roller body.

The feed roller 120 has the guide groove 125 formed at the center of the outer circumference thereof.

At this time, the media separation piece 135 formed on the separation roller 131 of the media separator 130 is inserted into the guide groove 125 so as to overlap the feed roller 120. The guide groove 125 will be described later in detail when the media separator 130 is described.

The media separator 130 faces the feed roller 120, includes the plurality of separation rollers 131 and 132 and the separation belt 133 wound around each of the separation roller 131 and 132, and separates a following medium 12 through friction of the separation belt 133, the following medium 12 being in close contact with a leading medium 11 transferred by the feed roller 120 and transferred at the same time as the leading medium 11.

More specifically, as illustrated in FIGS. 2 and 3, the first separation roller 131 is disposed at a position facing the feed roller 120 in a vertical direction, the second separation roller 132 is disposed separately from the first separation roller 131 toward the transfer path, and the separation belt 133 is wound around each of the first and second separation rollers 131 and 132, and separates the following medium 12 from the leading medium 11, the following medium 12 being in close contact with the leading medium 11 transferred by the feed roller 120 and transferred at the same time as the leading medium 11.

At this time, the separation belt 133 may include a pair of separation belts 133 wound around both sides of the circumference of each of the first and second separation rollers 131 and 132. The pair of separation belts 133 face both outer circumferential surfaces of the feed roller 120, respectively, with the guide groove 125 of the feed roller 120 interposed therebetween.

The first and second separation rollers 131 and 132 of the media separator 130 may stand still or rotate in the opposite direction of the media feeding direction. When the first and second separation rollers 131 and 132 are rotated in the opposite direction of the media feeding direction, the separation belts 133 wound around the first and second separation rollers 131 and 132 are rotated in the opposite direction of the media feeding direction along the first and second separation rollers 131 and 132.

In such a configuration, the separation belt 133 of the media separator 130 is rotated in the opposite direction of the media feeding direction, and disposed in such a manner that the surface of the separation belt 133 faces one of the outer circumferential surfaces of the feed roller 120. Thus, while a medium 10 picked up and transferred by the pickup roller 110 is introduced between the feed roller 120 and the separation belts 133, a following medium 12 may be in close contact with the rear surface of the medium 10 fed by the feed roller 120 through the frictional force between the media 10 and 12, and transferred at the same time as the medium 10. In this case, the following medium 12 contacted with the rear surface of the medium 11 fed by the feed roller 120 is separated through the friction of the separation belts 133 which are rotated in the opposite direction of the media feeding direction. In this way, the media 10 are separated one by one and then transferred toward the transfer path.

At this time, the friction coefficient of the friction member 121 formed on the feed roller 120 is set to a larger value than the friction coefficient of the separation belt 133. Thus, the medium 10 transferred by the friction member 121 of the feed roller 120 may be passed between the feed roller 120 and the separation belt 133 while overcoming the friction with the separation belt 133. On the other hand, the following medium 12 which is in close contact with the rear surface of the leading medium 11 fed by the feed roller 120 and transferred at the same time as the learning medium 11 can be separated from the leading medium 11 by the friction with the separation belt 133.

The first separation roller 131 disposed at the entrance into which the medium 10 picked up by the media separator 130 is introduced includes the media separation piece 135 for preventing simultaneous introduction of a bundle of media 11 to 13 overlapping each other.

The media separation piece 135 is formed around the center of the outer circumferential surface of the first separation roller 131 while having a predetermined thickness, and protrudes from the outer circumferential surface of the first separation roller 131. Furthermore, the media separation piece 135 is partially inserted into the guide groove 125 of the feed roller 120 facing the first separation roller 131 and partially overlaps the circumferential end portion of the feed roller 120. Thus, when a bundle of several media 11 to 13 attached to each other by the frictional force among the media is introduced while the medium 11 picked up and transferred by the pickup roller 110 is introduced between the feed roller 120 and the media separator 130, the media separation piece 135 blocks the introduction of the following media 12 and 13 which are in close contact with the rear surface of the leading medium 11 and introduced at the same time as the leading medium 11, such that only the leading medium 11 is introduced between the feed roller 120 and the media separator 130.

The media separation piece 135 may be made of urethane rubber.

As illustrated in FIGS. 2 and 3, the media separation piece 135 is formed on the first separation roller 131 disposed at the entrance into which the picked-up medium 10 is introduced. Specifically, the media separation piece 135 is formed on the outer circumferential surface of the roller body of the first separation roller 131 between the pair of separation belts 133 along the center of the circumferential surface, while protruding from the outer circumferential surface, and disposed in the guide groove 125 of the feed roller 120 of which the protruding ends face each other, such that the end portion of the media separation piece 135 partially overlaps the circumferential end of the feed roller 120.

At this time, the overlap structure in which the end portion of the media separation piece 135 is inserted and disposed in the guide groove 125 can effectively prevent media 10 from being simultaneously introduced while overlapping each other, because the media 10 including various types of bills and checks have a thickness of 0.07 mm to 0.2 mm. The media separation piece may have a thickness T of 0.5 mm to 2 mm, the width W of the guide groove into which the media separation piece is inserted may be set to 1.5 to 2.5 times of the thickness T of the media separation piece, and the overlap portion between the end portion of the media separation piece and the circumferential end portion of the feed roller may have a length of 0.05 mm to 0.4 mm.

In the present embodiment, the thickness T of the media separation piece may be set to 1 mm, the width W of the guide groove into which the media separation piece is inserted may be set to 2 mm, the depth D of the guide groove may be set to 1.5 mm, and the length L of the overlap portion between the end portion of the media separation piece and the circumferential end portion of the feed roller may be set to 0.2 mm. In the overlap structure, among the media 11 to 13 which are introduced while overlapping each other, the following media 12 and 13 which are in close contact with the rear surface of the leading medium 11 and introduced at the same time as the leading medium 11 can be effectively prevented from being introduced between the feed roller 120 and the media separator 130.

That is, when three media 11 to 13 overlapping each other are introduced between the feed roller 120 and the first separation roller 131 as illustrated in FIG. 2, the media separation piece 135 formed with the overlap structure blocks the introduction of two media 12 and 13 contacted with the rear surface of the media 11 transferred by the pickup roller 110 among the three media 11 to 13, while passing one medium 11 picked up and transferred by the pickup roller 110.

As such, the media separation apparatus according to the embodiment of the present invention includes the media separation piece 135 which is formed at the center of the outer circumferential surface of the first separation roller 131 disposed at the entrance into which media are introduced, and partially overlaps the circumferential end portion of the feed roller 120. When a bundle of two or more media 11 to 13 overlapping each other is introduced between the feed roller 120 and the media separator 130, the media separation piece 135 blocks the introduction of the following media 12 and 13 which are in close contact with the rear surface of the leading medium 11 and introduced at the same time as the leading medium 11, thereby preventing the media from being separated as a bundle of two or more media during the media separation process by the feed roller 120 and the media separator 130.

During the above-described transfer process, although two media 11 and 12 among the three media 11 to 13 overlapping each other are simultaneously passed through the media separation piece 135 and introduced between the feed roller 120 and the media separator 130, the following medium 12 contacted with the rear surface of the leading medium 11 can be separated through the separation belts 133 of the media separator 130. In this way, the media 10 can be separated one by one and transferred toward the transfer path.

The media separation apparatus having the above-described configuration according to the embodiment of the present invention may be installed in a deposit/withdrawal unit that stores media (bills or checks) inserted by a customer, a temporary storage unit that temporarily stores the deposited media until a transaction is settled, or a media cassette that stores media for transaction, in the ATM, and serve to separate the stored media one by one and transfer the separated media toward the transfer path.

Hereafter, the operation process of the media separation apparatus according to the embodiment of the present invention will be described.

FIGS. 4 to 7 are diagrams illustrating the operation process of the media separation apparatus according to the embodiment of the present invention.

Figure 4:
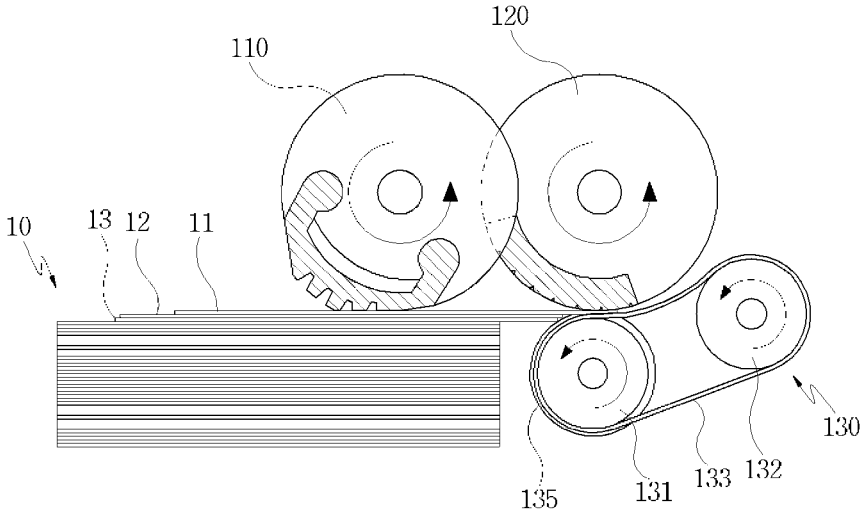
FIGS. 4 through 7 are diagrams illustrating an operation process of the media separation apparatus according to the embodiment of the present invention.

As illustrated in FIG. 4, the pickup roller 110 is rotated to sequentially pick up the loaded media 10 from the top through the pickup member 111 formed at a part of the outer circumferential surface of the roller body, and transfers the picked-up media 10 between the feed roller 120 and the media separator 130, in order to separate the loaded media 10 one by one and transfer the separated media 10 toward the transfer path.

At this time, when media 12 and 13 are in close contact with the rear surface of the medium 11 picked-up and transferred by the pickup roller 110 due to the frictional force among the media 11 to 13 such that the three media 11 to 13 overlapping each other are introduced between the feed roller 120 and the first separation roller 131, the media separation piece 135 formed on the first separation roller 131 blocks a part of the introduced media 11 to 13. That is, the media separation piece 135 blocks two media 12 and 13 contacted with the rear surface of the medium 11 picked up and transferred by the pickup roller 110, while passing the medium 11 picked up and transferred by the pickup roller 110 among the three media 11 to 13.

Figure 5:
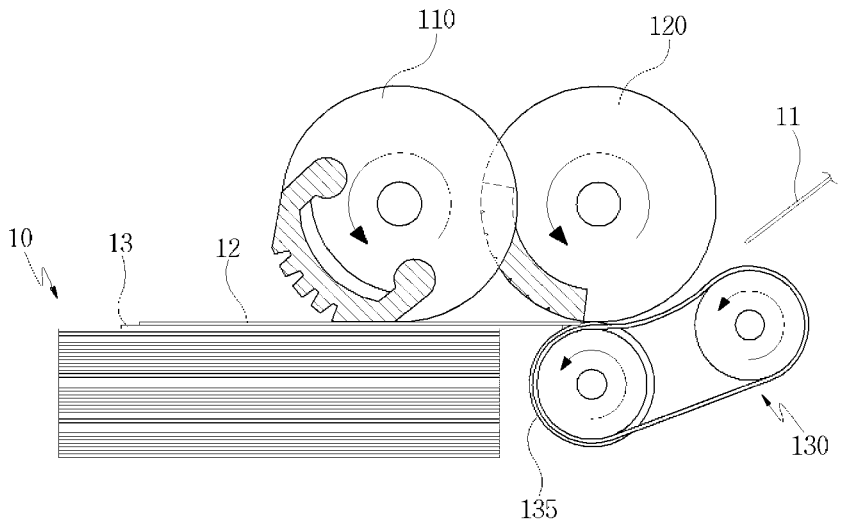

Then, as illustrated in FIG. 5, when the medium 11 picked up and transferred by the rotations of the pickup roller 110 and the feed roller 120 is completely passed through the media separation piece 135, the leading medium 12 between the media 12 and 13 having been blocked by the media separation piece 135 is picked up by the pickup roller 110 and transferred between the feed roller 120 and the media separator 130. As the above-described process is repeated, the loaded media 10 may be transferred one by one between the feed roller 120 and the media separator 130.

As such, the media separation apparatus according to the embodiment of the present invention can effectively prevent two or more media from being transferred between the feed roller and the media separator, through the media separation piece which partially overlaps the circumferential end portion of the feed roller.

Figure 6:
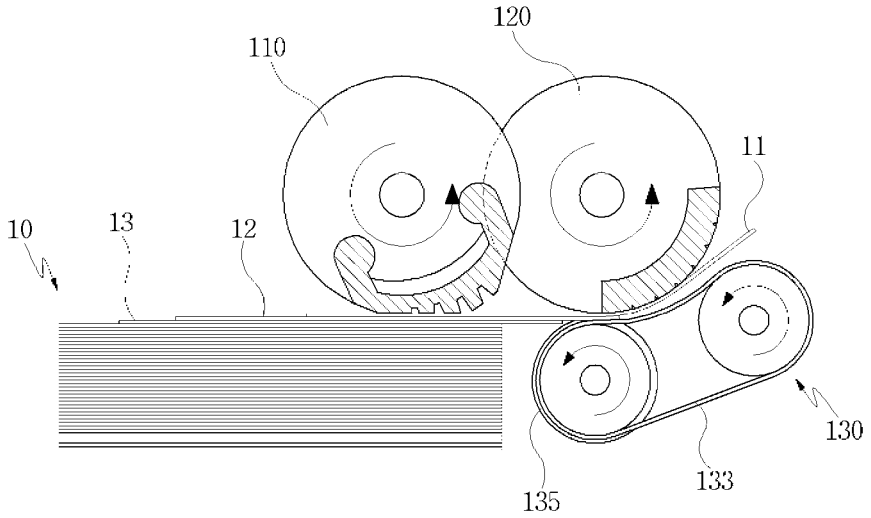
Figure 7:
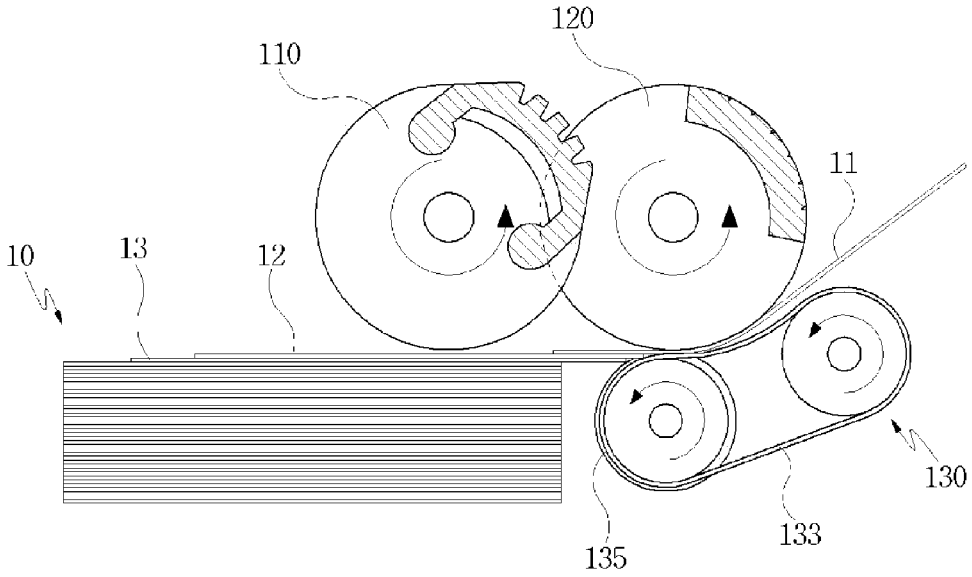

During the above-described transfer process, although two media 11 and 12 among the three overlapping media 11 to 13 are simultaneously passed through the media separation piece 135 and introduced between the feed roller 120 and the media separator 130 as illustrated in FIG. 6, the following medium 12 contacted with the rear surface of the leading medium 11 can be separated through the separation belts 133 of the media separator 130, which are rotated in the opposite direction of the media feeding direction, as illustrated in FIG. 7. At this time, the case in which a bundle of three or more media is passed through the media separation piece hardly occurs, considering the characteristic of the overlap structure. In this way, the media 10 can be separated one by one and transferred toward the transfer path.

As described above, the media separation apparatus according to the embodiment of the present invention includes the feed roller having the guide groove formed at the center of the outer circumferential surface thereof, and the media separation piece which is formed at the center of the outer circumferential surface of the separation roller disposed at the media entrance among the plurality of separation rollers included in the media separator and protrudes from the outer circumferential surface of the separation roller, such that the end portion of the media separation piece partially overlaps the circumferential end portion of the feed roller. Thus, when a bundle of two or more media is introduced between the feed roller and the media separator while a medium picked up and transferred by the pickup roller is introduced between the feed roller and the media separator, the media separation piece blocks the introduction of the following medium which is in close contact with the rear surface of the leading medium and introduced at the same time as the leading medium. Thus, the media separation apparatus can effectively prevent the media from being separated as a bundle of two or more media during the media separation process by the feed roller and the media separator, thereby increasing the media separation efficiency.

While various embodiments have been described above, it will be understood to those skilled in the art that the embodiments described are by way of example only. Accordingly, the disclosure described herein should not be limited based on the described embodiments.

What is claimed is:

1. A media separation apparatus which separates loaded media one by one and transfers the separated media toward a transfer path, comprising:

a pickup roller disposed at one side of the loaded media, and configured to sequentially pick up and transfer the loaded media;

a feed roller disposed separately from the pickup roller in a media feeding direction, and configured to feed the media picked up and transferred by the pickup roller toward the transfer path; and a media separator disposed at a position facing the feed roller, having a plurality of separation rollers and a separation belt wound around a part of a circumference of each of the separation rollers, and configured to separate a following medium from a leading medium through friction of the separation belt, the following medium being in close contact with the leading medium fed by the feed roller and transferred at the same time as the leading medium, wherein the feed roller has a guide groove formed at a center of an outer circumferential surface of the feed roller, wherein at least one separation roller of the plurality of separation rollers is disposed at an entrance into which the picked-up and transferred medium is introduced and has a media separation piece which protrudes from the center of the outer circumferential surface of the at least one separation roller such that a protruding end portion thereof is inserted into the guide groove of the feed roller, and wherein while the medium picked up and transferred by the pickup roller is introduced between the feed roller and the media separator, the media separation piece blocks the introduction of the following medium contacted with a rear surface of the leading medium, wherein the media separator comprises:

a first separation roller disposed at the entrance into which the picked-up and transferred medium is introduced, facing the feed roller in a vertical direction, and having the media separation piece protruding from the center of the outer circumferential surface of the roller body, a second separation roller disposed separately from the first separation roller toward the transfer path, and a pair of separation belts wound around both sides of the outer circumferential surfaces of the first and second separation rollers, with the media separation piece of the first separation roller interposed therebetween, and separating the following medium which is in close contact with the leading medium fed by the feed roller and transferred at the same time as the leading medium.

2. The media separation apparatus of claim 1, wherein the media separation piece has a thickness of 0.5 mm to 2 mm, and the width of the guide groove is 1.5 times to 2.5 times larger than the thickness of the media separation piece.

3. The media separation apparatus of claim 1, wherein the guide groove has a depth of 0.5 mm to 2 mm, and the end portion of the media separation piece, inserted into the guide groove, has a length of 0.05 mm to 0.4 mm.

4. The media separation apparatus of claim 1, wherein the media separation piece is formed around the circumference of the separation roller along the center of the outer circumferential surface of the separation roller.

5. The media separation apparatus of claim 1, wherein the pickup roller has a pickup member formed on a part of the outer circumferential surface of the roller body and coming in contact with the loaded media so as to pick up a medium, and the feed roller has a friction member formed on a part of the outer circumferential surface of the roller body and coming in contact with a transferred medium so as to transfer the medium.

6. The media separation apparatus of claim 5, wherein the friction member has a larger friction coefficient than the separation belt.

* * * * *